US008905574B2

(12) United States Patent
Li et al.

(10) Patent No.: US 8,905,574 B2
(45) Date of Patent: Dec. 9, 2014

(54) DEVICE FOR MOUNTING LED LAMP TUBE

(71) Applicants: Hong Fu Jin Precision Industry (ShenZhen) Co., Ltd., Shenzhen (CN); Hon Hai Precision Industry Co., Ltd., New Taipei (TW)

(72) Inventors: Jian Li, Shenzhen (CN); Li-Tao Zhang, Shenzhen (CN); Hua-Ren Xie, Shenzhen (CN); Da-Sheng Jia, Shenshen (CN); Wen-Hsiang Lu, New Taipei (TW)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 119 days.

(21) Appl. No.: 13/749,700

(22) Filed: Jan. 25, 2013

(65) Prior Publication Data

US 2013/0223054 A1 Aug. 29, 2013

(30) Foreign Application Priority Data

Feb. 23, 2012 (CN) ..... 2012 2 0059970

(51) Int. Cl.

| | |
|---|---|
| ***F21V 21/00*** | (2006.01) |
| ***G09F 13/04*** | (2006.01) |
| ***F21S 8/06*** | (2006.01) |
| ***F21V 19/00*** | (2006.01) |
| *F21K 99/00* | (2010.01) |
| *F21Y 101/02* | (2006.01) |

(52) U.S. Cl.

CPC . *F21V 21/00* (2013.01); *F21S 8/06* (2013.01); *F21V 19/009* (2013.01); *F21K 9/17* (2013.01); *F21Y 2101/02* (2013.01)

USPC ..... 362/217.17; 362/97.1; 362/97.2

(58) Field of Classification Search

USPC ..... 362/97.1, 97.2, 217.17

See application file for complete search history.

(56) References Cited

U.S. PATENT DOCUMENTS

| | | | | |
|---|---|---|---|---|
| 8,485,677 | B2 * | 7/2013 | Zhang | 362/97.1 |
| 2007/0183149 | A1 * | 8/2007 | Ko et al. | 362/225 |
| 2010/0103647 | A1 * | 4/2010 | Liao et al. | 362/97.1 |

* cited by examiner

*Primary Examiner* — Joseph L Williams

(74) *Attorney, Agent, or Firm* — Novak Druce Connolly Bove + Quigg LLP

(57) ABSTRACT

A device for mounting an LED lamp tube is provided. The device includes two mounting base, each of which includes a mounting socket, a rotary member and a connection member. The rotary member is received in a cavity defined in the mounting socket, and is rotatable with respect to the mounting socket, and remains static with respect to the mounting socket when not being rotated. The rotary member defines a pair of mounting holes for insertion of pins of the LED lamp tube thereinto. A first connection portion is formed on one end of the mounting socket. A second connection portion is formed on one end of the connection member, the second connection portion is configured for engaging with the first connection portion, to latchingly connect the connection member to the mounting socket, and retain the rotary member in the cavity of the mounting socket.

9 Claims, 5 Drawing Sheets

DEVICE FOR MOUNTING LED LAMP TUBE

BACKGROUND

1. Technical Field

The present disclosure relates to a device for mounting an LED lamp tube.

2. Description of Related Art

A lamp tube is not able to rotate around its circumferential direction when its two end portions are received in existing sockets. Light-emitting diodes (LEDs) can thus only emit light beams in one direction. With such a structure, the illumination angle of an LED lamp tube cannot be adjusted. Furthermore, it is easy to detach the lamp tube from the socket.

Therefore, a device for mounting lamp tube, which can allow adjustment of the illumination angle of the lamp tube, and effectively prevent the lamp tube automatically detaching from the device, is needed.

BRIEF DESCRIPTION OF THE DRAWINGS

Many aspects of the embodiments can be better understood with reference to the following drawings. The components in the drawings are not necessarily drawn to scale, the emphasis instead placed upon clearly illustrating the principles of the present disclosure. Moreover, in the drawings, like reference numerals designate corresponding parts throughout the several views.

DETAILED DESCRIPTION

Figure 1:
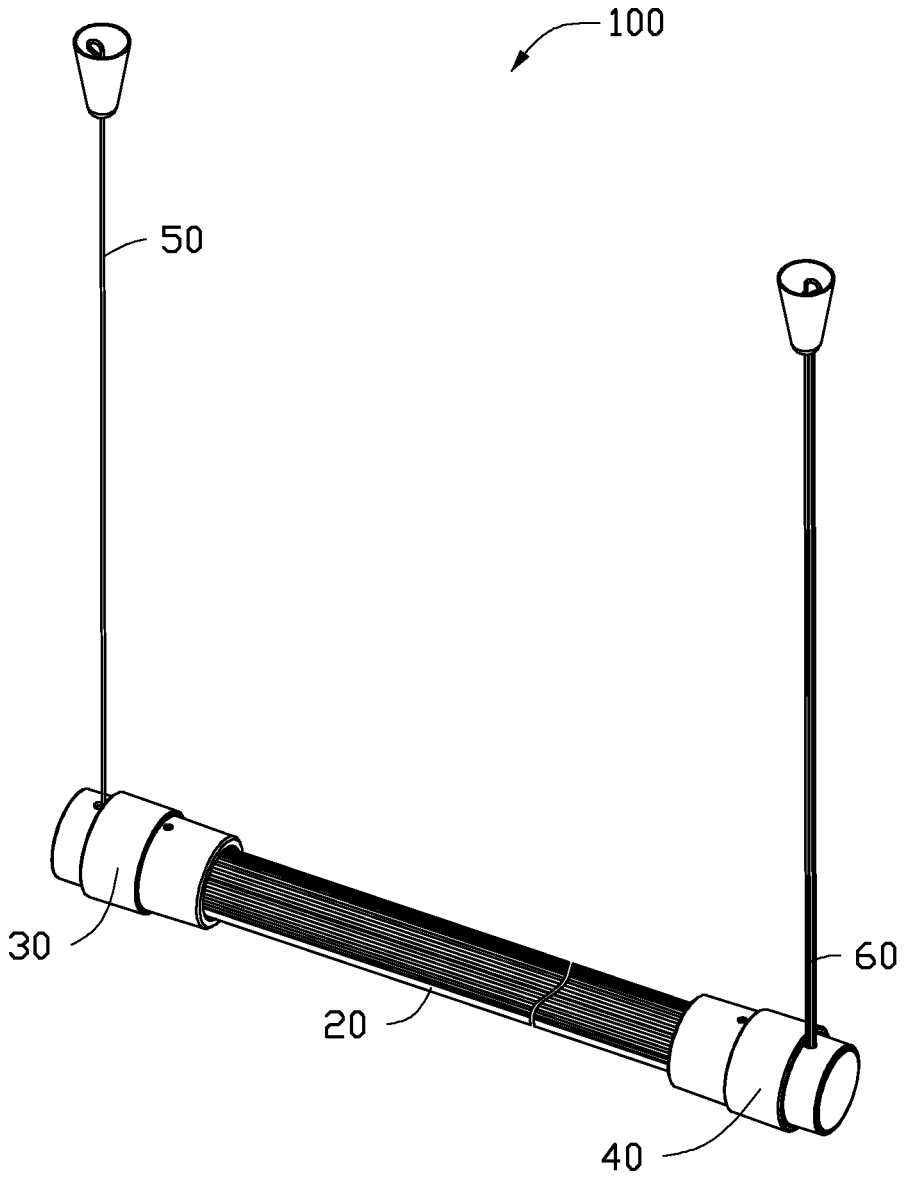
FIG. 1 is a schematic, isometric view of a device for mounting an LED lamp tube according to an exemplary embodiment.

Referring to FIG. 1, a device 100 for mounting an LED lamp tube 20 according to an exemplary embodiment is illustrated. The device 100 includes a first mounting base 30, a second mounting base 40 and at least one hanging member 50. The first mounting base 30 and the second mounting base 40 are configured for receiving opposite end portions of the LED lamp tube 20. The hanging member 50 is configured for suspending the LED lamp tube 20 from above. In the embodiment, there are two hanging members 50, first ends of the hanging members 50 are fixed to the first mounting base 30 and the second mounting base 40, and second ends of the hanging member 50 are fixed to a ceiling. In an alternative embodiment, the LED lamp tube 20 can be fixed to a wall in a cantilever arrangement by fixing the first mounting base 30 and the second mounting base 40 to the wall. A cable 60 is arranged along the hanging member 50 to connect the LED lamp tube 20 to an external power source (not shown).

Figure 2:
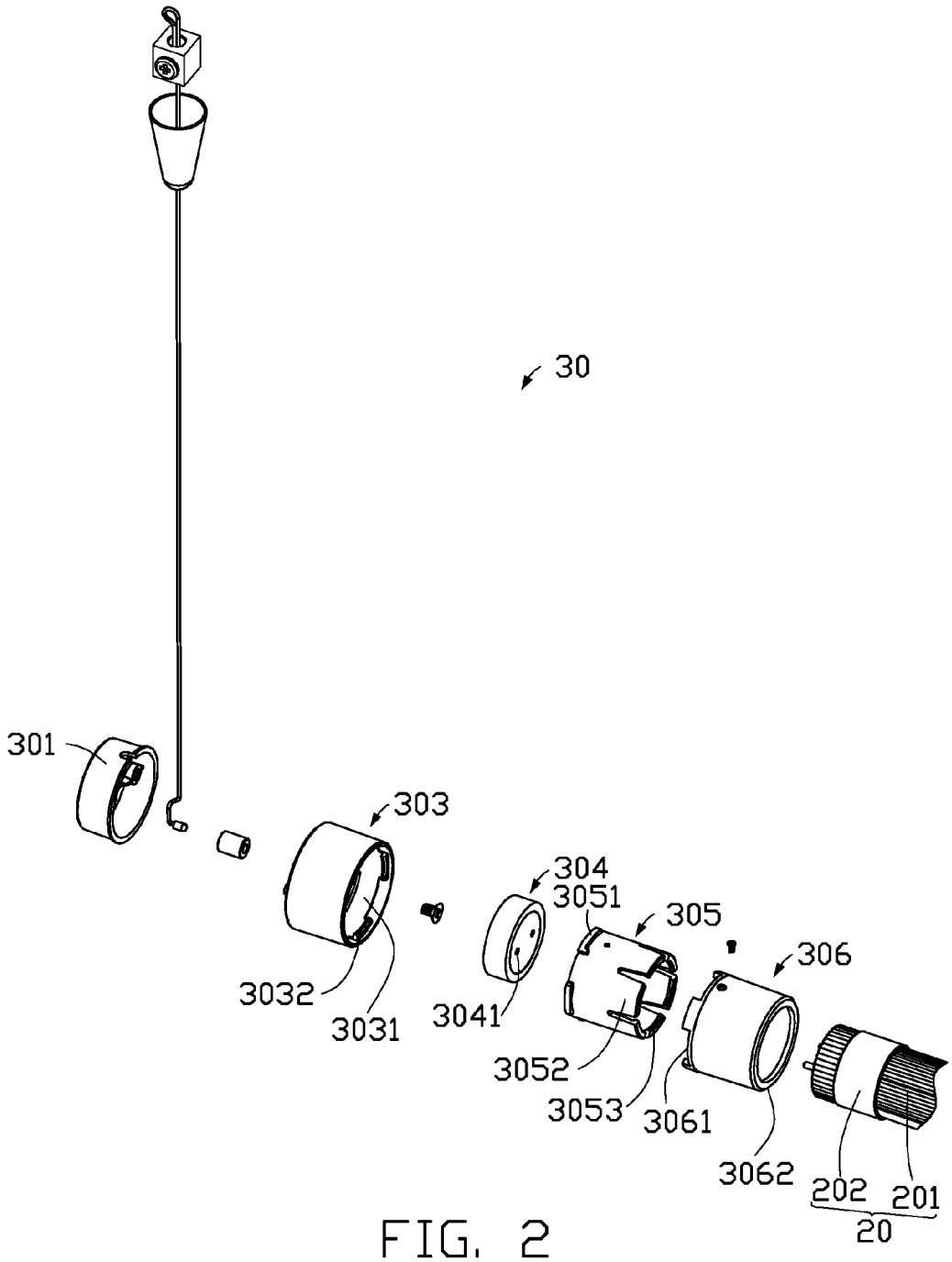
FIG. 2 is a partial, exploded view of the device of FIG. 1.
Figure 3:
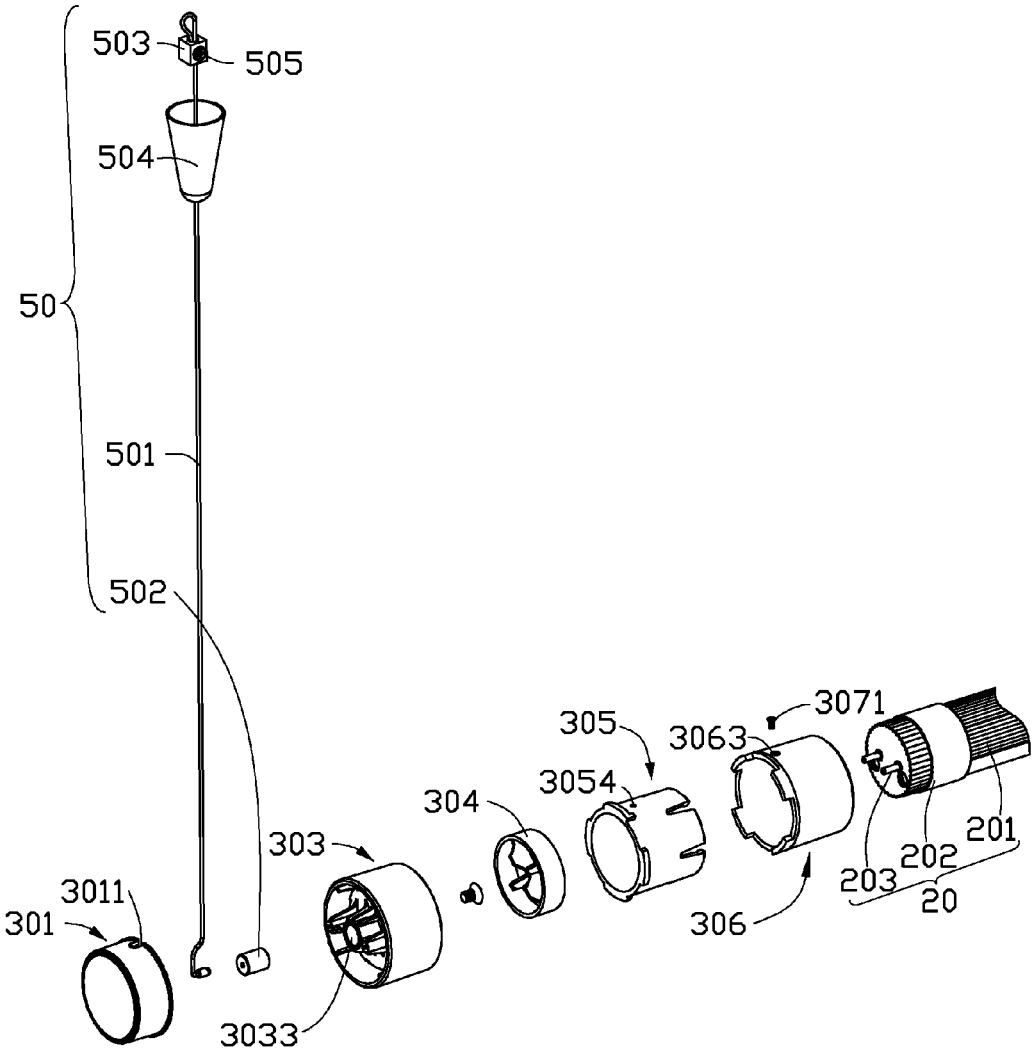
FIG. 3 is another partial, exploded view similar to FIG. 2, but viewed from a different aspect.

Referring to FIGS. 2-3, in the embodiment, the LED lamp tube 20 includes a tubular lamp body 201 and a pair of end caps 202 attached to opposite end portions of the lamp body 201. In the embodiment, each end cap 202 includes a pair of pins 203.

The first mounting base 30 includes an end cover 301, a mounting socket 303, a rotary member 304, a connection member 305 and a sleeve member 306. The mounting socket

303 defines a cavity 3031 therein for receiving the rotary member 304. The rotary member 304 defines a pair of mounting holes 3041 for insertion of the pins 203 thereinto.

A first connection portion 3032 is formed on one end of the mounting socket 303. In the embodiment, the first connection portion 3032 is formed to be a number of spaced ribs extending circumferentially along the inside surface of the cavity 3031.

A second connection portion 3051 is formed on one end of the connection member 305. The second connection portion 3051 engages with the first connection portion 3032, to latchingly connect the connection member 305 to the mounting socket 303. In the embodiment, the second connection portion 3051 is formed to be a number of spaced flanges extending circumferentially along the outside surface of the connection member 305.

A first stopper portion 3052 is formed on an opposite end of the connection member 305 to the second connection portion 3051. The first stopper portion 3052 resists against the corresponding end cap 202 close to the lamp body 201, so as to prevent lateral movement along the central lengthways axis of the LED lamp tube 20 between the first mounting base 30 and the second mounting base 40. In the embodiment, the first stopper portion 3052 is formed to be a number of elastic members separated from each other, and each end portion of the elastic member extends towards the inside to form a claw 3053. The connection member 305 defines an assembly hole 3054 in the surface thereof.

An engagement portion 3061 is formed at one end of the sleeve member 306, for latchingly engaging with the first connection portion 3032 and the second connection portion 3051, to prevent the connection member 305 detaching from the mounting member 303. In the embodiment, the engagement portion 3061 is formed to be a number of indentations engaging with the ribs 3032 and the flanges 3051. A second stopper portion 3062 is formed on an opposite end of the sleeve member 306 to the engagement portion, and the second stopper portion 3062 holds the first stopper portion 3052 of the connection portion 305. In the embodiment, the second stopper portion 3062 is formed to be an elastic flange extending towards the inside of the sleeve member 306. The sleeve member 306 defines an assembly hole 3063 spatially in a circumferential surface thereof corresponding to the assembly hole 3054.

Figure 4:
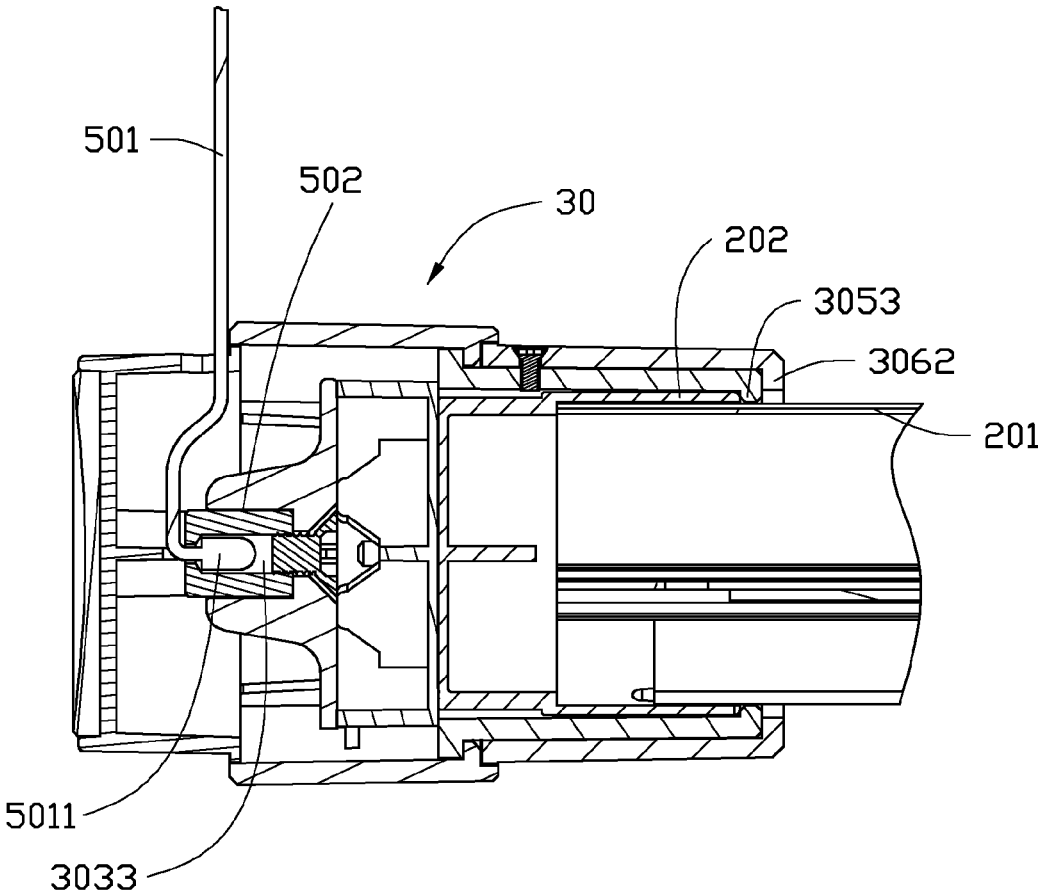
FIG. 4 is a partial, cross-sectional view of the device of FIG. 1.

Referring also to FIG. 4, in assembly, firstly, the sleeve member 306 and the connection member 305 are sleeved in the lamp body 201 in that order, the pins 203 are inserted into the mounting holes 3041 of the rotary member 304, and the rotary member 304 is received in the cavity 3031 of the mounting socket 303.

Secondly, the second connection portion 3051 of the connection member 305 is inserted into the cavity 3031 of the mounting socket 303 and located more inward than the first connection portion 3032 in the cavity 3031. In the embodiment, each flange of the second connection portion 3051 passes through a gap between the adjacent ribs of the first connection portion 3032, then the connection member 305 is rotated to make the ribs being juxtaposed with and engaged with the respective flanges. With such a structure, the connection member 305 is thus fastened to the mounting socket 303 with the first stopper portion 3052 resisting against the end of the end cap 202, and the rotary member 304 is retained in the cavity 3031 of the mounting socket 303 by the connection member 305. In the embodiment, the rotary member 304 is rotatable with respect to the mounting socket 303 under a pressure applied thereto, and remains stationary with respect to the mounting socket 303 when the pressure is removed.

With such a structure, when in use, the illumination angle of the LED lamp tube 20 can be freely adjusted by turning the LED lamp tube 20 to drive the rotary member 304 to any desired position.

Thirdly, the sleeve member 306 is sleeved in the connection member 305 with the indentations engaging with the ribs 3032 on the mounting socket 303 and the flanges 3051 on the connection member 305, and the second stopper portion 3062 holding the first stopper portion 3052. Finally, a bolt 3071 passes through the assembly hole 3063 on the sleeve member 306 and the assembly hole 3054 on the connection member 305 in that order, so as to fasten the sleeve member 306 and the connection member 305 together. With such a structure, automatic or accidental detachments of the LED lamp tube 20 are prevented.

Referring again to FIG. 3, in the embodiment, a through-hole 3033 is defined in the mounting socket 303. A notch 3011 is defined in one end portion of the end cover 301 close to the mounting socket 303. Referring also to FIG. 4, in assembly, one end of the hanging member 50 passes through the through-hole 3033 and is fixed in the mounting socket 303. The end cover 301 is fixed to the mounting socket 303 with the hanging member 50 passing through the notch 3011.

Figure 5:
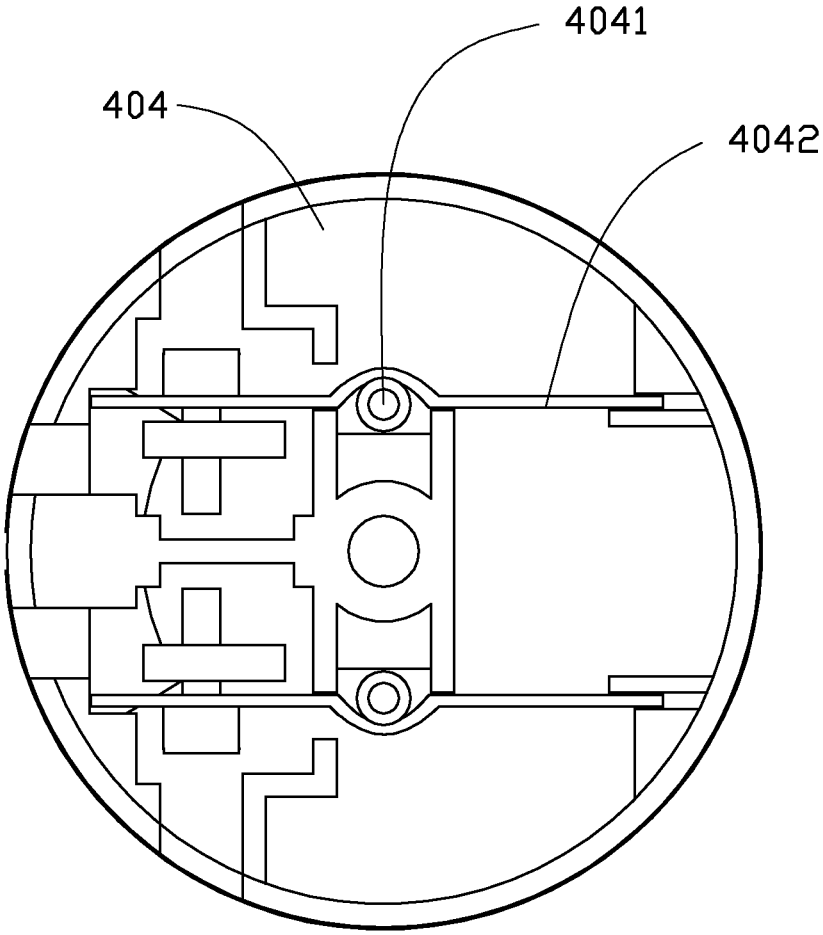
FIG. 5 is an end view of a rotating member of the device of FIG. 1.

In the embodiment, the structure of the second mounting base 40 is similar to that of the first mounting base 30. Referring to FIG. 5, a pair of metal pieces 4042 are mounted in the mounting hole 4041 on the rotary member 404 of the second mounting base 40. The metal pieces 4042 connect the pins 203 to the cable 60 when the pins 203 of the LED lamp tube 20 are inserted into the mounting holes 4041 of the rotary member 404, to provide power to the LED lamp tube 20.

Moreover, it is to be understood that the disclosure may be embodied in other forms without departing from the spirit thereof. Thus, the present examples and embodiments are to be considered in all respects as illustrative and not restrictive, and the disclosure is not to be limited to the details given herein.

What is claimed is:

1. A device for mounting an LED lamp tube, the LED lamp tube comprising a tubular lamp body and a pair of end caps attached to opposite end portions of the lamp body, each end cap comprising a pair of pins; the device comprising a first mounting base and a second mounting base configured for receiving opposite end portions of the LED lamp tube, each of the first mounting base and the second mounting base comprising:

a mounting socket including a cavity defined therein and a first connection portion arranged at one end thereof;

a rotary member received in the cavity of the mounting socket, and being rotatable with respect to the mounting socket under a pressure applied thereto, and remaining stationary with respect to the mounting socket when the pressure is removed; the rotary member defining a pair of mounting holes for insertion of the pins of the LED lamp tube thereinto; and a connection member, wherein a second connection portion is formed on one end of the connection member, the second connection portion is configured for engaging with the first connection portion, to latchingly connect the connection member to the mounting socket, and retain the rotary member in the cavity of the mounting socket; a first stopper portion is formed on an opposite end of the connection member to the second connection portion, the first stopper portion is configured for resisting against the corresponding end cap.

2. The device of claim 1, wherein the first connection portion includes a plurality of spaced ribs extending circumferentially along the inside surface of the cavity, the second connection portion includes a plurality of spaced flanges extending circumferentially along the outside surface of the connection member, the second connection portion being inserted into the cavity of the mounting socket and located more inward than the first connection portion in the mounting socket, the ribs being juxtaposed with and engaged with the respective flanges.

3. The device of claim 2, further comprising a sleeve member, wherein an engagement portion is formed at one end of the sleeve member, for latchingly engaging with the first connection portion and the second connection portion, to prevent the connection member detaching from the mounting member.

4. The device of claim 3, wherein the engagement portion includes a plurality of indentations engaging with the ribs and the flanges.

5. The device of claim 4, wherein a second stopper portion is formed on an opposite end of the sleeve member to the engagement portion, and the second stopper portion is configured for holding the first stopper portion of the connection portion.

6. The device of claim 5, wherein the second stopper portion includes an elastic flange extending towards the inside of the sleeve member.

7. The device of claim 5, wherein a first assembly hole is defined in the surface of the connection member, a second assembly hole spatially corresponding to the first assembly hole is defined in a circumferential surface of the sleeve member, the first assembly hole and the second assembly hole are configured for extension of a bolt to fasten the sleeve member and the connection member together.

8. The device of claim 1, wherein the first stopper portion includes a plurality of elastic members separated from each other, and each end portion of the elastic member extends towards the inside to form a claw.

9. The device of claim 1, wherein a pair of metal pieces are mounted in the mounting hole on the rotary member of one of the first mounting base and the second mounting base, the metal pieces is configured for connecting the pins of the LED lamp tube to an external power source via a cable.

* * * * *